US007918111B2

(12) United States Patent
Uliano

(10) Patent No.: US 7,918,111 B2
(45) Date of Patent: Apr. 5, 2011

(54) LOCK DEVICE THAT ENABLE USERS TO CHOOSE THE SECURITY LEVEL OF THE LOCK

(76) Inventor: George Uliano, Orlando, CA (US)

( * ) Notice: Subject to any disclaimer, the term of this patent is extended or adjusted under 35 U.S.C. 154(b) by 527 days.

(21) Appl. No.: 12/056,273

(22) Filed: Mar. 27, 2008

(65) Prior Publication Data

US 2009/0133450 A1 May 28, 2009

Related U.S. Application Data

(60) Provisional application No. 60/989,916, filed on Nov. 23, 2007.

(51) Int. Cl.
*E05B 67/36* (2006.01)

(52) U.S. Cl. ..... 70/32; 70/369; 70/370; 70/2

(58) Field of Classification Search ..... 70/2, 6–13, 70/32–34, 367, 369–371, 374
See application file for complete search history.

(56) References Cited

U.S. PATENT DOCUMENTS

| | | | | | |
|---|---|---|---|---|---|
| 924,331 | A * | 6/1909 | Feola | 70/32 |
| 1,561,254 | A * | 11/1925 | Ledin | 70/370 |
| 1,912,663 | A * | 6/1933 | Shinn | 70/33 |
| 2,059,698 | A * | 11/1936 | Jacobi | 70/369 |
| 3,299,678 | A | 1/1967 | Spencer | |
| 3,316,742 | A * | 5/1967 | Wellekens | 70/379 R |
| 3,391,555 | A * | 7/1968 | Mamo | 70/258 |
| 3,769,821 | A | 11/1973 | Randel | |
| 4,009,599 | A * | 3/1977 | Patriquin | 70/90 |
| 4,697,444 | A * | 10/1987 | Maffey | 70/232 |
| 4,751,831 | A * | 6/1988 | Morris et al. | 70/159 |
| 4,838,055 | A | 6/1989 | Gallagher | |
| 4,899,561 | A | 2/1990 | Myers | |
| 5,038,588 | A | 8/1991 | Hall | |
| 5,127,244 | A | 7/1992 | Myers | |
| 5,172,574 | A | 12/1992 | Perfetto | |
| 5,345,794 | A | 9/1994 | Jenks | |
| 5,669,255 | A | 9/1997 | Albano | |
| 5,921,119 | A | 7/1999 | Myers et al. | |
| 5,946,952 | A | 9/1999 | Mintchenko | |
| 6,029,484 | A * | 2/2000 | Jetton | 70/371 |
| 6,338,261 | B1 | 1/2002 | Liu | |
| 6,766,671 | B2 | 7/2004 | Haczynski et al. | |
| 6,823,703 | B2 * | 11/2004 | Shiao et al. | 70/369 |
| 7,406,847 | B2 * | 8/2008 | Yuhi et al. | 70/360 |
| 7,752,874 | B2 * | 7/2010 | Foti | 70/33 |
| 2003/0188558 | A1 * | 10/2003 | Shiao et al. | 70/369 |
| 2004/0011092 | A1 * | 1/2004 | Haczynski et al. | 70/23 |
| 2005/0252257 | A1 * | 11/2005 | Woods et al. | 70/33 |
| 2008/0105004 | A1 * | 5/2008 | Wang | 70/2 |
| 2008/0105005 | A1 * | 5/2008 | Wang | 70/32 |

* cited by examiner

*Primary Examiner* — Suzanne D Barrett
(74) *Attorney, Agent, or Firm* — Ariel S. Bentolila; Bay Area IP Group, LLC

(57) ABSTRACT

A lock device includes a universal spacer, for receiving a lock cylinder, and a plurality of spacer holes where one of the holes is positioned to receive a lock bolt of the lock cylinder. A padlock body houses the universal spacer. A plurality of padlock body holes extends from an interior of a universal spacer hole into the padlock body. The padlock body holes are positioned to match the spacer holes and one of the padlock body holes receives the lock bolt when the lock cylinder is in a locked position. A padlock bolt secures the universal spacer, lock cylinder and padlock body in place when the lock cylinder is in the locked position. When the lock cylinder is in the unlocked position, the universal spacer with the lock cylinder can be removed from the universal spacer hole and the lock cylinder can be replaced with another lock cylinder.

18 Claims, 4 Drawing Sheets

LOCK DEVICE THAT ENABLE USERS TO CHOOSE THE SECURITY LEVEL OF THE LOCK

CROSS-REFERENCE TO RELATED APPLICATIONS

The present Utility patent application claims priority benefit of the U.S. provisional application for patent Ser. No. 60/989,916 filed on 23 Nov. 2007 under 35 U.S.C. 119(e). The contents of this related provisional application are incorporated herein by reference for all purposes.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to locks. More particularly, the invention relates to locks incorporating universal spacers that enable users to choose the security level of the locks.

BACKGROUND OF THE INVENTION

Many current padlocks use lock cylinders that are incorporated into the padlock and cannot be changed by the end user. Therefore, a padlock is sold at a particular security level, and this security level cannot be changed, for example, without limitation, upgraded to a higher level of security. Many styles of padlocks are available, for example, without limitation, Offset "Hockey Puck" style, flat back "Hockey Puck" style solid steel round and square body padlocks, laminated padlocks, aluminum body padlocks, double ball locking padlock and single ball locking padlocks, high security padlocks. Other types of locks and padlocks include without limitation, vending or T-handle locks. Current padlocks also do not enable users to change the security level of the locks.

Currently there are some solutions to provide changeable padlocks; however these solutions require the use of different types of sleeves with each lock or require specialized locks. For example, without limitation, solutions to this problem include a rekeyable lock, a lock with a pop-out lock mechanism, and a lock with a removable cylinder and/or locking pins. These solutions enable the user to change the security level of the lock; however, a specialized lock must be used in these solutions. Another existing solution is a padlock that enables the end user to change locks using a removable core lock, which is a lock that goes into a door and uses multiple keys to remove the lock. However, this solution uses sleeves with a mechanism on the back end rather than a universal spacer.

In view of the foregoing, there is a need for improved techniques for providing a lock with a universal spacer that enables a user to change the security level of the lock by just replacing the lock (lock cylinder).

BRIEF DESCRIPTION OF THE DRAWINGS

The present invention is illustrated by way of example, and not by way of limitation, in the figures of the accompanying drawings and in which like reference numerals refer to similar elements and in which:

FIG. 1 is an exploded view,

FIG. 2 is a side view with a lock bolt of the vending lock in an unlocked position, FIG. 3 is a side view with the lock bolt of the vending lock in a locked position. And FIG. 4 is a side view with the padlock bolt moved out of the hasp slot.

Figure 1:
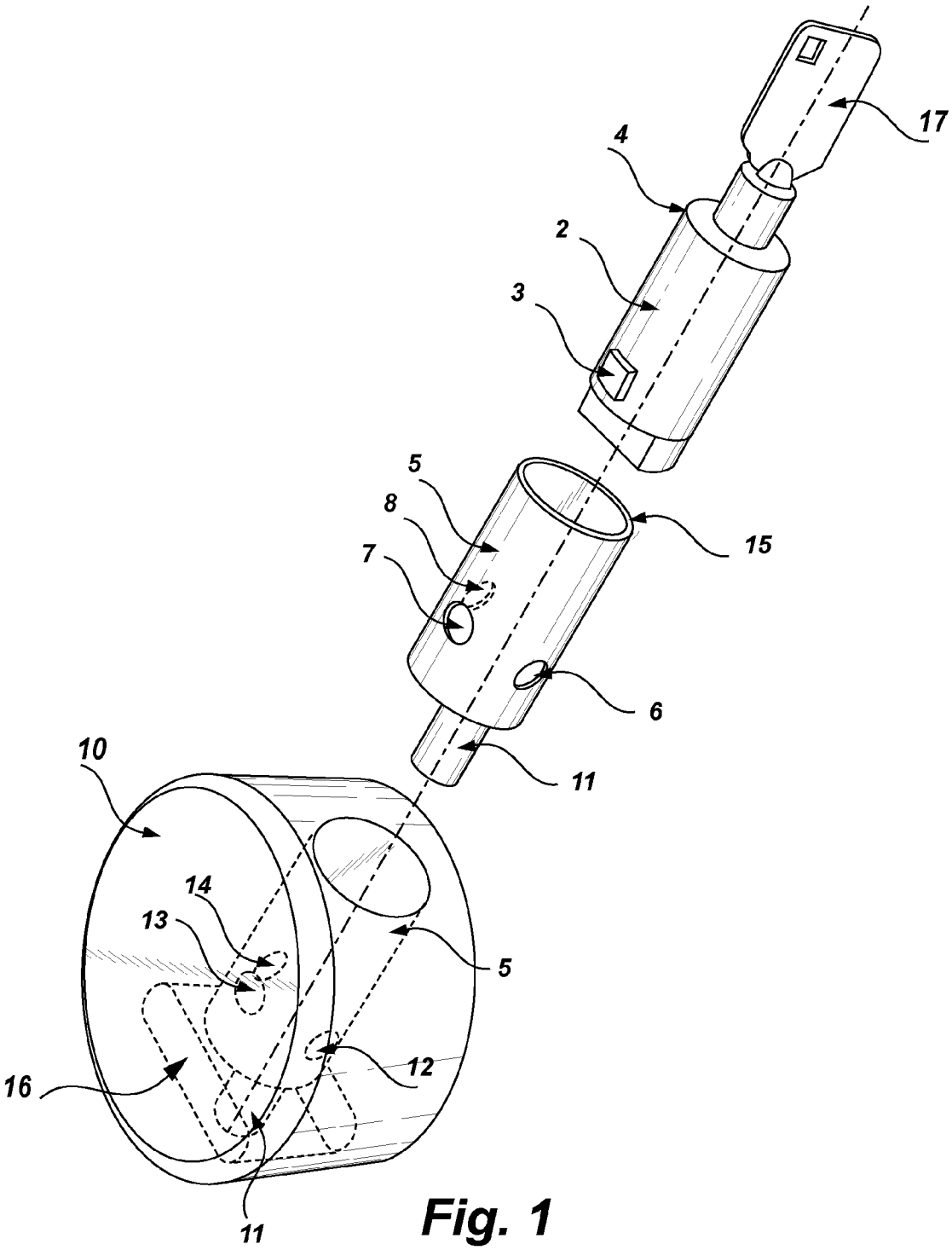
FIGS. 1, 2, 3 and 4 illustrate an exemplary padlock incorporating a universal spacer and an interchangeable vending lock, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, a lock device that enable users to choose the security level of the lock is presented.

In one embodiment, a lock device for allowing a lock cylinder to be changed is presented. The device includes a universal spacer including dimensions for receiving the lock cylinder and a plurality of spacer holes where one of the spacer holes is positioned to receive a moveable lock bolt of the lock cylinder. A padlock body includes a universal spacer hole for housing the universal spacer with the lock cylinder and a plurality of padlock body holes extending from an interior of the universal spacer hole into the padlock body. The padlock body holes are positioned to match the spacer holes and one of the padlock body holes receives the movable lock bolt when the lock cylinder is placed in a locked position. A padlock bolt secures the universal spacer, lock cylinder and padlock body in place when the lock cylinder is placed in the locked position. When the lock cylinder is placed in the unlocked position, the movable lock bolt is retracted from the one of the padlock body holes, the universal spacer with the lock cylinder can be removed from the universal spacer hole disengaging the padlock bolt and the lock cylinder can be replaced with another lock cylinder. In another embodiment the padlock body further includes a hasp slot where, when a hasp is inserted into the hasp slot, the padlock bolt can engage the hasp for securing. In still another embodiment the padlock bolt is attached to the universal spacer. In yet another embodiment the padlock body further includes a hockey puck style without an outwardly visible shackle. In various other embodiments the universal spacer is cylindrical in shape, the spacer and padlock body holes are circular in shape and the padlock bolt is cylindrical in shape. In other embodiments the universal spacer is dimensioned for an off the shelf vending or T-handle lock and the hasp slot includes dimensions suitable for accepting the hasp on a vending machine. In still another embodiment a level of security can be changed when the lock cylinder is replaced.

In another embodiment a lock device for allowing a lock cylinder to be changed is presented. The device includes a universal spacer including dimensions for receiving the lock cylinder, a plurality of spacer holes where one of the spacer holes is positioned to receive a moveable lock bolt of the lock cylinder and a padlock bolt. A padlock body includes a universal spacer hole for housing the universal spacer with the lock cylinder and a plurality of padlock body holes extending form an interior of the universal spacer hole into the padlock body. The padlock body holes are positioned to match the spacer holes and one of the padlock body holes receives the movable lock bolt when the lock cylinder is placed in a locked position. The padlock bolt secures the universal spacer, lock cylinder and padlock body in place when the lock cylinder is placed in the locked position. When the lock cylinder is placed in the unlocked position, the movable lock bolt is retracted from the one of the padlock body holes, the universal spacer with the lock cylinder can be removed from the universal spacer hole disengaging the padlock bolt and the lock cylinder can be replaced with another lock cylinder. In another embodiment the padlock body further includes a hasp slot where, when a hasp is inserted into the hasp slot, the padlock bolt can engage the hasp for securing. In yet another embodiment the padlock body further includes a hockey puck style without an outwardly visible shackle. In various other embodiments the universal spacer is cylindrical in shape, the spacer and padlock body holes are circular in shape and the padlock bolt is cylindrical in shape. In still other embodiments the universal spacer is dimensioned for an off the shelf vending or T-handle lock and the hasp slot includes dimensions suitable for accepting the hasp on a vending machine. In still another embodiment a level of security can be changed when the lock cylinder is replaced.

In another embodiment a lock device for allowing a lock cylinder to be changed is presented. The device includes means for receiving the lock cylinder, means for housing the receiving means and means for securing the receiving and housing means when the lock cylinder is placed in a locked position and when the lock cylinder is placed in the unlocked position the receiving means can be removed from the housing means and the lock cylinder can be replaced with another lock cylinder.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

In the preferred embodiment of the present invention, a padlock incorporates a universal spacer and standard off the shelf vending or T-handle locks, which are available from many different manufactures. These vending or T-handle locks can be used with the universal spacer without any modification to the vending lock itself. The preferred embodiment is used in a shackleless padlock; however a universal spacer can be used in many different types of padlocks in various alternate embodiments. In preferred embodiments of the present invention, the ability to use different vending locks with a universal spacer enables an end user to choose the type and level of security for a lock simply by changing the vending lock. In the preferred embodiment, the use of a universal spacer enables the lock itself to be separate from the padlock. The universal spacer in the preferred embodiment not only enables a user to use many different types of vending locks, it also provides the padlock lock bolt.

Figure 2:
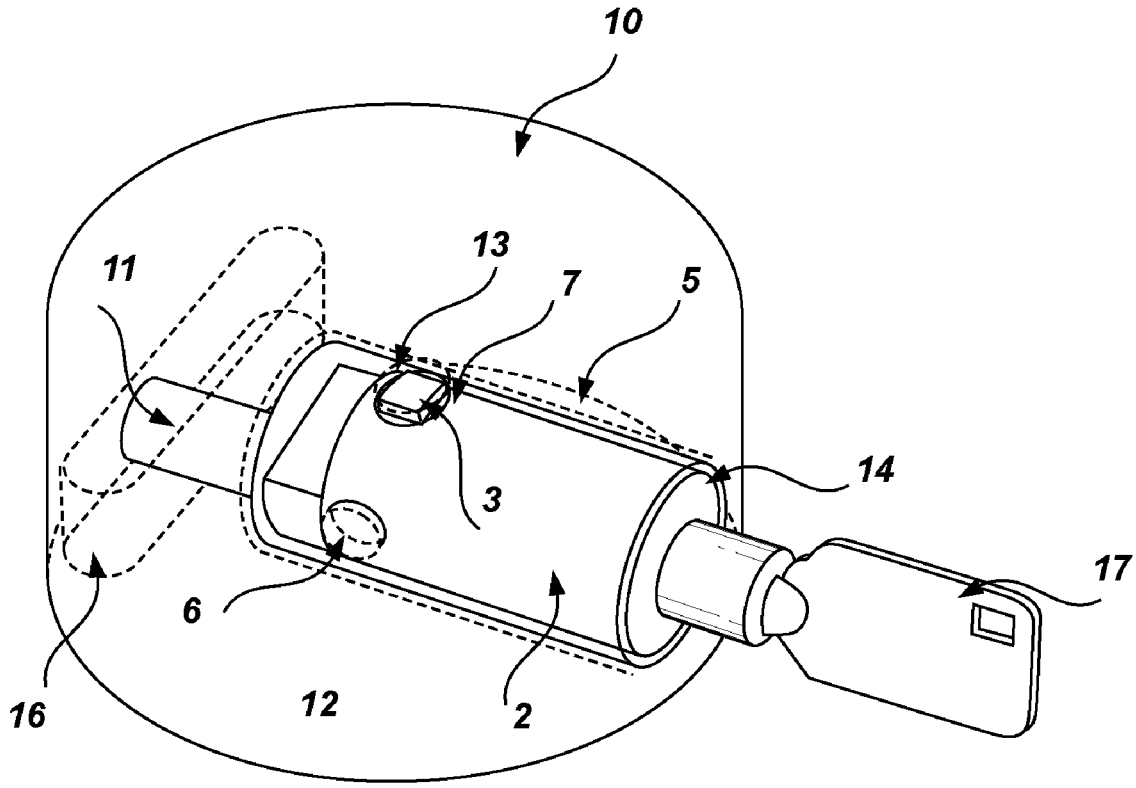
Figure 3:
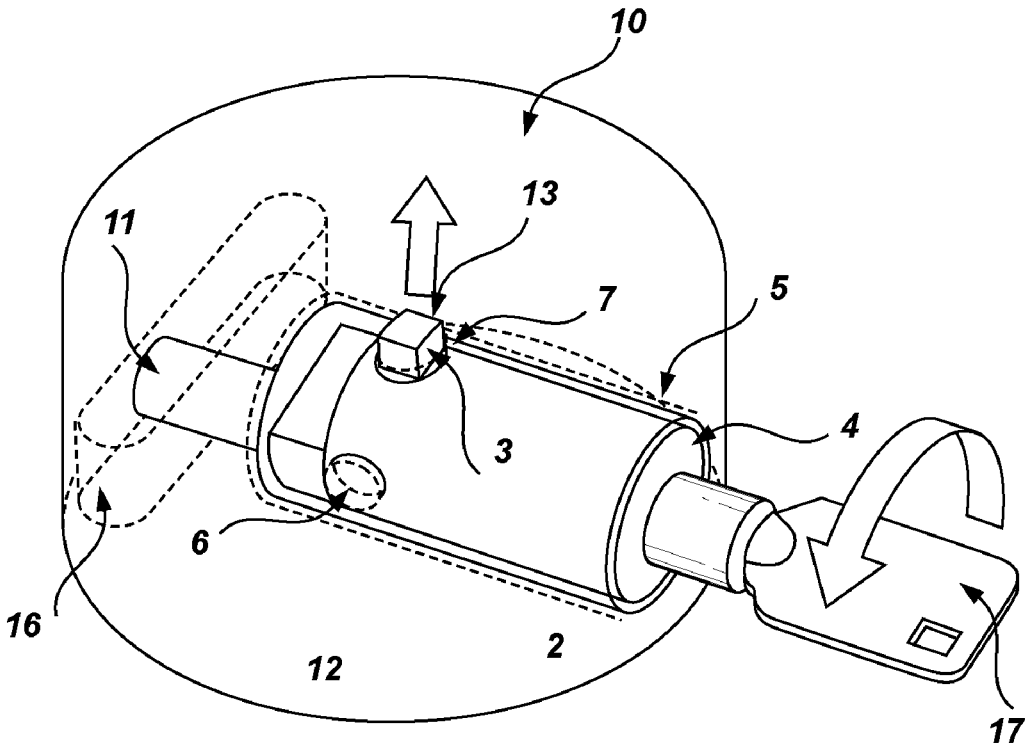
Figure 4:
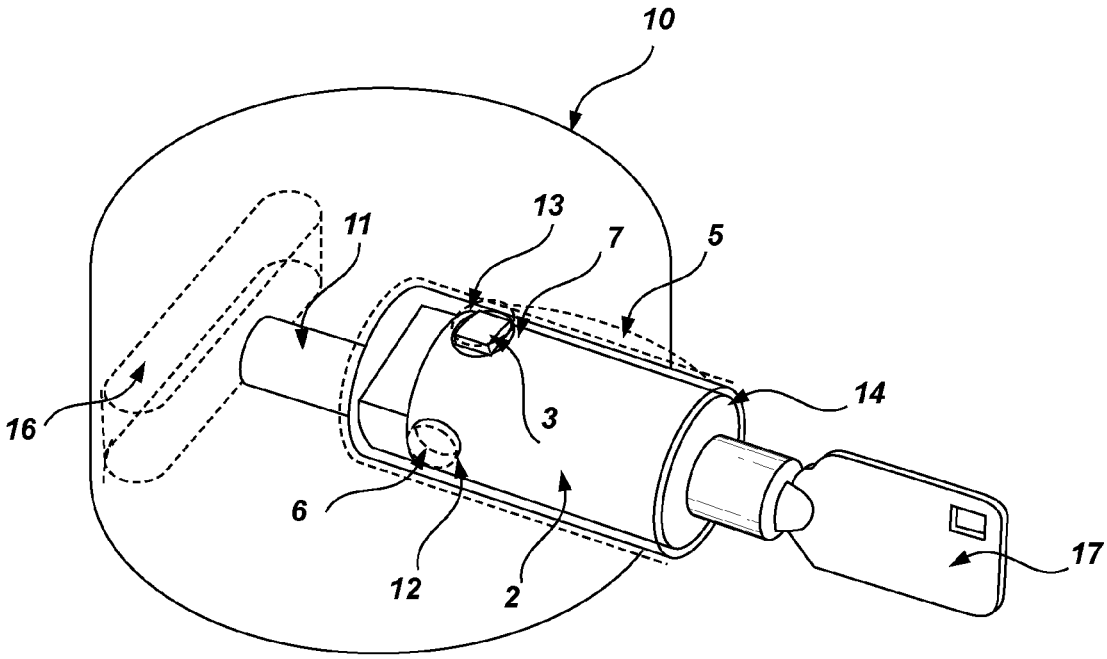

FIGS. 1, 2, 3 and 4 illustrate an exemplary padlock incorporating a universal spacer 5 and an interchangeable vending lock 2, in accordance with an embodiment of the present invention. FIG. 1 is an exploded view, FIG. 2 is a side view with a lock bolt 3 of vending lock 2 in an unlocked position, FIG. 3 is a side view with lock bolt 3 of vending lock 2 in a locked position and FIG. 4 is a side view with the padlock bolt moved out of the hasp slot. In the present embodiment, the padlock comprises a padlock body 10, universal spacer 5, and a representative vending lock 2. Vending locks or T-handle locks, for example, without limitation, vending lock 2, are widely used in the vending industry. Vending locks are standard locks with only a lock bolt, for example, without limitation, lock bolt 3 on vending lock 2, in slightly different positions on each lock. Since the distance between lock bolt 3 and a lock front 4 on vending lock 2 varies on different vending locks, holes 6, 7, 8 in universal spacer 5 are positioned at various distances from a spacer front 15 to accommodate for this difference and enable various vending locks to lock properly. Padlock body 10 comprises holes 12, 13, and 14 corresponding to holes 6, 7, and 8 in universal spacer 5 positioned so that when a vending lock is inserted into padlock body 10, holes 6, 7, and 8 in universal spacer 5 align with holes 12, 13, and 14 in padlock body 10 enabling the lock bolt on the vending lock to be inserted into the corresponding holes. Alternate embodiments may have more or fewer holes in the universal spacer and the padlock body in order to accommodate more or fewer vending locks. In the present embodiment, holes 12, 13, and 14 in padlock body 10 match the circumference of holes 6, 7, and 8 in universal spacer 5; however, in alternate embodiments holes in the universal spacer and the padlock body may vary in circumference. In alternate embodiments, the individual holes in the universal spacer may vary in circumference in order to accommodate lock bolts of various sizes, and in these embodiments, the individual holes in the padlock body may also vary in circumference. In the present embodiment, vending lock 2 is inserted into universal spacer 5 so that lock bolt 3 aligns with hole 7. Then, universal spacer 5 along with vending lock 2 is inserted into padlock body 10 so that lock bolt 3 and hole 7 align with hole 13 in padlock body 10, as shown by way of example in FIGS. 2 and 3.

In the present embodiment, universal spacer 5 also comprises a padlock bolt 11. When universal spacer 5 and vending lock 2 are inserted into padlock body 10, padlock bolt 11 acts as the locking mechanism that goes through a hasp that is inserted into a hasp slot 16 in padlock body 10. In the present embodiment, padlock body 10 and universal spacer 5 are made from steel; however in alternate embodiments these elements may be made of other materials such as, but not limited to, aluminum, other types of metal, metal composites, etc. By incorporating padlock bolt 11 into universal spacer 5, the padlock in the present embodiment is a self-contained locking device. Thus, universal spacer 5 not only holds vending lock 2; universal spacer 5 is also the locking bolt of the padlock. In alternate embodiments, the locking bolt may be separate from the universal spacer or could be another shape square instead of round.

FIG. 2 shows vending lock 2 inserted into universal spacer 5 then inserted into padlock body 10 in the unlocked position. In the present embodiment, hole 7 on universal spacer 5 aligns with hole 13 in padlock body 10, with lock bolt 3 in the proper position to lock. Also shown is padlock bolt 11 in position in hasp slot 16 to secure padlock body 10 to the hasp device. Depending on the particular vending lock being used, the lock bolt of the vending lock may align with various holes in universal spacer 5 and padlock body 10. For example, without limitation, some vending locks may align with hole 6 in universal spacer 5 and hole 12 in padlock body 10, or hole 8 in universal spacer 5 and hole 14 in padlock body 10.

FIG. 3 shows vending lock 2 inserted into universal spacer 5 then inserted into padlock body 10 in the locked position with lock bolt 3 going through universal spacer 5 and into padlock body 10. Lock bolt 3 is inserted through hole 7 in universal spacer 5 and into hole 13 of padlock body 10. Padlock bolt 11 is shown in the locked position in hasp slot 16.

FIG. 4 illustrates vending lock 2 in the open position with lock bolt 3 is in the down position. In this position lock bolt 3 is not engaged into padlock hole 13, therefore the universal spacer 5 and vending lock 2 are able to move out of the padlock body 10. As this movement progresses lock bolt 3 moves out of the hasp slot 16 freeing the padlock from the hasp and releasing the hasp from the padlock. In order to move lock bolt 3 from the unlocked position, as shown by way of example in FIG. 2, to the locked position in the present embodiment, a user turns a key 17, which causes lock bolt 3 to extend outward through hole 7 and hole 13, thus securing vending lock 2 and universal spacer 5 in padlock body 10. Key 17 may then be removed from vending lock 2 so that unauthorized persons may not operate the padlock. In alternate embodiments using T-handle locks, a T-handle is unlocked with a key and turned in order to extend or retract the lock bolt of the T-handle lock.

In preferred embodiments of the present invention, the use of universal spacers in the shackleless padlocks or other padlocks enables the use of standard off the shelf vending locks in different security levels. By aligning the holes in the universal spacer with holes in the padlock body, many different types of vending locks may be accommodated. In typical use of the present embodiment, an end user can change vending lock 2 in padlock body 10 using universal spacer 5. Holes 6, 7, and 8 enable universal spacer 5 to accept different types of common vending style locks. The security level of the padlock can be changed by replacing one vending lock for another vending lock, for example, without limitation, replacing a medium security vending lock with a high security vending lock. Changing the security level of a padlock using existing solutions typically requires the entire padlock to be replaced.

To change vending lock 2 in the present embodiment, the user moves lock bolt 3 to the unlocked position by turning key 17. Then, vending lock 2 and universal spacer 5 may be removed from padlock body 10. Then, the user may insert another vending lock or T-handle lock into universal spacer 5 so that the lock bolt of the vending lock is aligned with one of the holes, hole 6, 7, or 8, in universal spacer 5. Then universal spacer 5 and the vending lock are inserted into padlock body 10 so that the lock bolt and the hole in universal spacer 5 that is aligned with the lock bolt align with one of the holes, hole 12, 13, or 14, in padlock body 10. Once the lock bolt of the vending lock and the holes are aligned, the user can insert the key for the vending lock into the lock and turn the key to move the lock bolt into the locked position, thus securing universal spacer 5 and the vending lock into place in padlock body 10. Using preferred embodiments of the present invention with universal spacers, an end user can change locks using vending locks that he already has. This reduces the cost of the padlock. Currently, there are no existing padlocks that use a standard off the shelf vending lock that can be changed by the end user.

The particular padlock shown by way of example in FIGS. 1 through 4 is known as a hockey puck style padlock due to its shape and appearance. The Padlock has no outwardly visible shackle. The present embodiment uses this type of shackleless padlock body to accept a universal spacer; however a universal spacer may be used in other types of padlock bodies such as, but not limited to, Offset "Hockey Puck" style, flat back "Hockey Puck" style, solid steel round and square body padlocks, laminated padlocks, aluminum body padlocks, double ball locking padlock and single ball locking padlocks, high security padlocks.

In particular industries many customers may want to use the same key in padlocks and other equipment, for example, without limitation, a vending customer who has vending machines that he wishes to lock with a machine lock and a padlock that use the same key. The universal spacer according to the preferred embodiment of the present invention enables the vending customer to use the exact same vending lock and key that is used by the vending machine in the padlock. Some of the different industries that may use embodiments of the present invention include, without limitation, vending businesses, bottling businesses, casino businesses, car wash businesses, coin laundry businesses, alarm businesses, and other businesses that use vending and/or cam locks.

As vending locks change or new locks are introduced, preferred embodiments of the present invention may be modified by drilling the holes in the correct positions in the universal spacer and padlock body to accommodate the lock bolts of the vending locks. Alternate embodiments may comprise various numbers of holes in the universal spacer and padlock body depending on the number of vending locks that these embodiments may accommodate. In an alternate embodiment the universal spacer may be countersunk into the padlock body further and the universal spacer and vending lock may be covered with a cover.

Having fully described at least one embodiment of the present invention, other equivalent or alternative methods of providing an interchangeable lock with a universal spacer according to the present invention will be apparent to those skilled in the art. The invention has been described above by way of illustration, and the specific embodiments disclosed are not intended to limit the invention to the particular forms disclosed. For example, the particular implementation of the universal spacer may vary depending upon the particular type of lock used. The locks described in the foregoing were directed to cylindrical implementations; however, similar techniques are to provide universal spacers that may accommodate locks of different cross-sectional shapes such as, but not limited to, square, rectangular, ovular, etc. Non-cylindrical implementations of the present invention are contemplated as within the scope of the present invention. The invention is thus to cover all modifications, equivalents, and alternatives falling within the spirit and scope of the following claims.

What is claimed is:

1. A lock device for allowing a lock cylinder to be changed, the device comprising:

a universal spacer comprising dimensions for receiving the lock cylinder and a plurality of spacer holes where one of said spacer holes is positioned to receive a moveable lock bolt of the lock cylinder;

a padlock body comprising a universal spacer hole for housing said universal spacer with the lock cylinder, a hasp slot, and a plurality of padlock body holes extending from an interior of said universal spacer hole into said padlock body, said padlock body holes positioned to match said spacer holes and one of said padlock body holes receives the movable lock bolt when the lock cylinder is placed in a locked position; and a padlock bolt operable to engage a hasp inserted into said hasp slot for securing said universal spacer, lock cylinder and padlock body in place when the lock cylinder is placed in the locked position and, when the lock cylinder is placed in the unlocked position, the movable lock bolt is retracted from said one of said padlock body holes, said universal spacer with the lock cylinder can be removed from said universal spacer hole disengaging said padlock bolt and the lock cylinder can be replaced with another lock cylinder.

2. The device as recited in claim 1, wherein said padlock bolt is attached to said universal spacer.

3. The device as recited in claim 1, wherein said padlock body further comprises a hockey puck style without an outwardly visible shackle.

4. The device as recited in claim 1, wherein said universal spacer is cylindrical in shape.

5. The device as recited in claim 1, wherein said spacer and padlock body holes are circular in shape.

6. The device as recited in claim 1, wherein said padlock bolt is cylindrical in shape.

7. The device as recited in claim 1, said universal spacer is dimensioned for a vending lock or T-handle lock.

8. The device as recited in claim 7, wherein said hasp slot comprises dimensions suitable for accepting a hasp on a vending machine.

9. The device as recited in claim 1, wherein a level of security can be changed when the lock cylinder is replaced.

10. A lock device for allowing a lock cylinder to be changed, the device comprising:

a universal spacer comprising dimensions for receiving the lock cylinder, a plurality of spacer holes where one of said spacer holes is positioned to receive a moveable lock bolt of the lock cylinder, and a padlock bolt; and a padlock body comprising a universal spacer hole for housing said universal spacer with the lock cylinder, a hasp slot, and a plurality of padlock body holes extending form an interior of said universal spacer hole into said padlock body, said padlock body holes positioned to match said spacer holes and one of said padlock body holes receives the movable lock bolt when the lock cylinder is placed in a locked position, said padlock bolt operable to engage a hasp inserted into said hasp slot for securing said universal spacer, lock cylinder and padlock body in place when the lock cylinder is placed in the locked position and, when the lock cylinder is placed in the unlocked position, the movable lock bolt is retracted from said one of said padlock body holes, said universal spacer with the lock cylinder can be removed from said universal spacer hole disengaging said padlock bolt and the lock cylinder can be replaced with another lock cylinder.

11. The device as recited in claim 10, wherein said padlock body further comprises a hockey puck style without an outwardly visible shackle.

12. The device as recited in claim 10, wherein said universal spacer is cylindrical in shape.

13. The device as recited in claim 10, wherein said spacer and padlock body holes are circular in shape.

14. The device as recited in claim 10, wherein said padlock bolt is cylindrical in shape.

15. The device as recited in claim 11, said universal spacer is dimensioned for a vending lock or T-handle lock.

16. The device as recited in claim 15, wherein said hasp slot comprises dimensions suitable for accepting a hasp on a vending machine.

17. The device as recited in claim 10, wherein a level of security can be changed when the lock cylinder is replaced.

18. A lock device for allowing a lock cylinder to be changed, the device comprising:

means for receiving the lock cylinder and a moveable lock bolt of the lock cylinder;

means for housing said receiving means and for receiving a hasp; and means operable to engage the hasp for securing said receiving and housing means when the lock cylinder is placed in a locked position and when the lock cylinder is placed in the unlocked position said receiving means can be removed from said housing means and the lock cylinder can be replaced with another lock cylinder.

* * * * *